United States Patent [19]

Suzuki et al.

[11] 4,004,406

[45] Jan. 25, 1977

[54] SPUN TYPE YARN AND PROCESS FOR MANUFACTURING THE SAME

[75] Inventors: Hirotsugu Suzuki; Yo Ogawa; Yoshikazu Kikuchi; Shin-ichi Kitazawa, all of Otsu, Japan

[73] Assignee: Toray Industries, Inc., Tokyo, Japan

[22] Filed: Apr. 16, 1975

[21] Appl. No.: 568,654

[30] Foreign Application Priority Data

Apr. 22, 1974 Japan ..... 49-44497
Feb. 3, 1975 Japan ..... 50-13358

[52] U.S. Cl. ..... 57/140 R; 57/157 R
[51] Int. Cl.[2] ..... D02G 3/02; D02G 3/26
[58] Field of Search ..... 57/140 R, 144, 157 R, 57/157 MS, 157 F, 160, 34 R, 34 HS, 157 BY

[56] References Cited

UNITED STATES PATENTS

| | | | |
|---|---|---|---|
| 2,289,568 | 7/1942 | Bloch | 57/140 R X |
| 3,043,088 | 7/1962 | Breen | 57/140 R X |
| 3,111,805 | 11/1963 | Boyer | 57/140 BY |
| 3,538,701 | 11/1970 | Cannon et al. | 57/157 F |
| 3,596,458 | 8/1971 | Nakano et al. | 57/140 BY X |
| 3,732,684 | 5/1973 | Csok et al. | 57/157 F X |

*Primary Examiner*—Donald E. Watkins

[57] ABSTRACT

A spun-type yarn having a unique configuration and useful properties is manufactured by a novel process which comprises forming a ribbon-shaped fiber bundle being substantially free from twists and composed of randomly oriented continuous filaments, each of which comprises random bends and loops along its length, and then false twisting the ribbon-shaped bundle to consolidate it into a yarn. In the false-twisting, some of the filaments are broken.

16 Claims, 11 Drawing Figures

SPUN TYPE YARN AND PROCESS FOR MANUFACTURING THE SAME

This invention relates to a novel spun-type yarn having a unique configuration and a process for the manufacture thereof. More particularly, this invention relates to a novel spun-type yarn of a unique diversiform configuration and having useful properties and a false-twisting type process for manufacturing the same from a continuous filamentary fiber bundle.

BACKGROUND OF THE INVENTION

In general, conventional ring spinning requires a number of preparatory steps in the manufacturing of spun yarns of synthetic fibers. Disadvantages of the conventional process are low productivity, nep formation and increasing irregularity in weight per length in the opening and drafting stages. Therefore, the conventional ring spinning requires redundant steps in addition to the indispensable steps. Further, even the complicated steps of the conventional process, it is very difficult to form fibers of poor physical properties, such as fibers of cured novolac resin or cured novolacpolyamide resin, into yarns. In manufacturing spun yarns of textile fibers, for example, polyester fibers, polyamide fibers and polyacrylic fibers, conventional ring spinning requires a restriction on the diameter of supplied staple fiber. Thus, it is very difficult to manufacture spun yarns made of fibers of fine denier.

Much research effort has been directed and many methods have been proposed to remove these defects of the conventional ring spinning, as shown in U.S. Pat. No. 3,079,746, U.S. Pat. No. 3,365,872 and British Pat. No. 1,102,095.

U.S. Pat. Nos. 3,079,746 and 3,365,872 disclose the manufacture of spun yarns made of discontinuous fibers or a combination of discontinuous fibers with continuous strands. However, since these patents are confined to only improvements in the twisting step, many of the preparatory steps for making slivers in the ring spinning process still need to be improved.

British Pat. No. 1,102,095 discloses a product and a process wherein some qualities characteristic of a spun staple fiber yarn are imparted to continuous filamentary yarn. Such yarns are apt to have many long radially-projecting loops. However, the presence of these radially-projecting loops, particularly the presence of long loops on the surface of the yarns, imparts undesirable properties to the yarn. For instance, in knitting fabrics, long loops induce irregular tension when the yarn is unwound from a cone or a bobbin and cause many defects in the fabrics.

SUMMARY OF THE INVENTION

It is an object of this invention to prepare a spun-type yarn in various novel and useful forms.

Another object of this invention is to provide a novel and efficient process for manufacturing a spun-type yarn.

Other objects will become apparent from the following description as well as the accompanying drawings, and claims.

The novel spun-type yarn of this invention consists of a fiber bundle which is substantially free from true twists and composed of continuous and discontinuous filaments being complexly intertwined with one another and comprising random bends and loops along their lengths. The yarn has a spun yarn-like hand and appearance and desirable properties for knitted and woven fabrics.

The above-mentioned yarn having a unique diversiform configuration and useful properties can be manufactured by a process which comprises forming a ribbon-shaped fiber bundle being substantially free from twists and having randomly oriented or arranged continuous filaments, each of which comprises random bends and loops along its length, and then false twisting said ribbon-shaped bundle to consolidate it into a yarn while some of the filaments are broken in the false twisting.

DETAILED EXPLANATION OF THE INVENTION

This invention provides a novel and useful spun-type yarn. In general, the yarn of the present invention consists of a fiber bundle which is substantially free from true twists and is composed of continuous and discontinuous filaments. These continuous and discontinous filaments are complexly intertwined with one another and comprises random bends and loops along their lengths.

Figure 1:
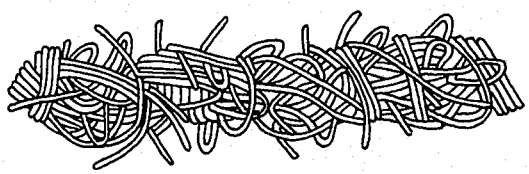
FIG. 1 is an enlarged schematic illustration of a yarn of this invention.

Referring now to FIG. 1, a typical yarn of this invention is schematically shown in an enlarged illustration. Some of the fiber bundle composing filaments are partially and randomly wrapped around the fiber bundle, while being intertwined with one another. The surface wrapping and entanglement as well as the entanglement within the fiber bundle give moderate coherency and strength to the yarn. Further, the yarn contains multiple free ends of broken, bent and looped filaments, which protrude from the fiber bundle of the yarn, so that the yarn possesses a spun yarn-like hand and appearance and, thus, can be made into fabrics having desirable functional properties such as those of spun yarn fabrics. The discontinuous broken filaments have irregular lengths and the surface wrapping filaments are wound around the fiber bundle at various angles with respect to the longitudinal axis of the yarn.

The above-mentioned unique and diversiform configuration of the yarn of the present invention may be conveniently characterized by parameters S and R as described below.

A test piece is arbitrarily cut at a length of 10 mm along the length of a yarn under a load of 500 mg/denier and the fiber length of the respective fibers contained in the test piece is then measured. Next, the parameters S and R are defined as follows:

$$S = B/A$$

$$R = C/D$$

wherein $A$ is the number of fibers whose length is in the range of not less than 10 mm but less than 12 mm, $B$ is the number of fibers whose length is in the range of not less than 12 mm but less than 30 mm, $C$ is the number of fibers whose length is not less than 30 mm and $D$ is the number of fibers contained in the test piece.

Thus, the yarn of this invention preferably has a value of the parameter S of not less than 0.5, more preferably of not less than 1.0, and most preferably a value of the parameter S of not less than 1.0 and a value of the parameter R of not more than 0.1.

The properties represented by the parameters S and R will become apparent from the following explanation. In the case of yarns composed of multifilaments arranged parallel to the longitudinal axis of the yarn, the value of the parameter S is equal to zero. In a staple spun yarn obtained by conventional ring spinning, fibers are oriented or arranged in the lengthwise direction of the yarn by the drafting operation during the yarn manufacturing process. However, the value of the parameter S is not usually equal to zero because the yarn is actually twisted. In the case of a yarn which has many radially projecting short loops, radially projecting short fibers and/or wrapping fibers on the yarn surface, the value of the parameter S is fairly large and, in general, the yarn has desirable properties in bulkiness and uniformity of unwinding tension when the yarn is unwound from a cone or a bobbin.

As mentioned above, it is easily understood that the parameter S indicates the degree of orientation or arrangement of the yarn composing fibers and the properties, such as bulkiness and uniformity of unwinding tension, of the yarn. Parameter R is another measure of the uniformity of unwinding tension. A yarn of the parameter R having a large value is inferior in its uniformity of unwinding tension because of the presence of many radially projecting long loops and/or radially projecting long fibers on the yarn surface. From our experience, it has been confirmed that a yarn of the parameter S of not less than 0.5 and the parameter R of not more than 0.1 has the most desirable bulkiness and uninformity of unwinding tension.

The yarn of this invention is manufactured by the following novel process which comprises forming a ribbon-shaped fiber bundle being substantially free from twists and composed of randomly oriented or arranged continuous filaments, each of which comprises random bends and loops along its length, and then false twisting the ribbon-shaped bundle to consolidate it into a yarn. In the false-twisting operation, some of the filaments are broken by a means for false twisting.

The ribbon-shaped bundle may be formed by extruding polymer melt into filaments through a spinneret, stretching the filaments thus formed preferably pneumatically by compressed air jets and then depositing them on a receiving conveyor which advances the filaments deposited thereon.

Figure 2:
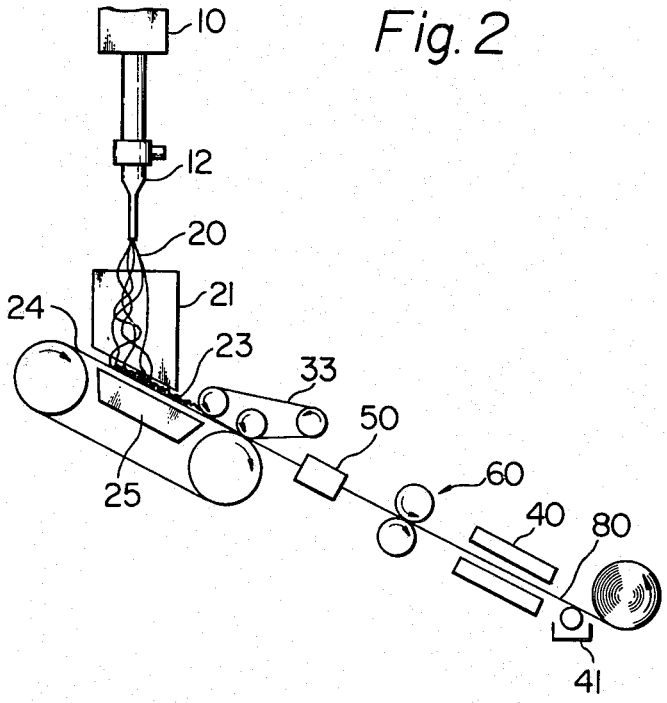
FIG. 2 is a side view schematically illustrating one form of the apparatus for use in the process of this invention.
Figure 3:
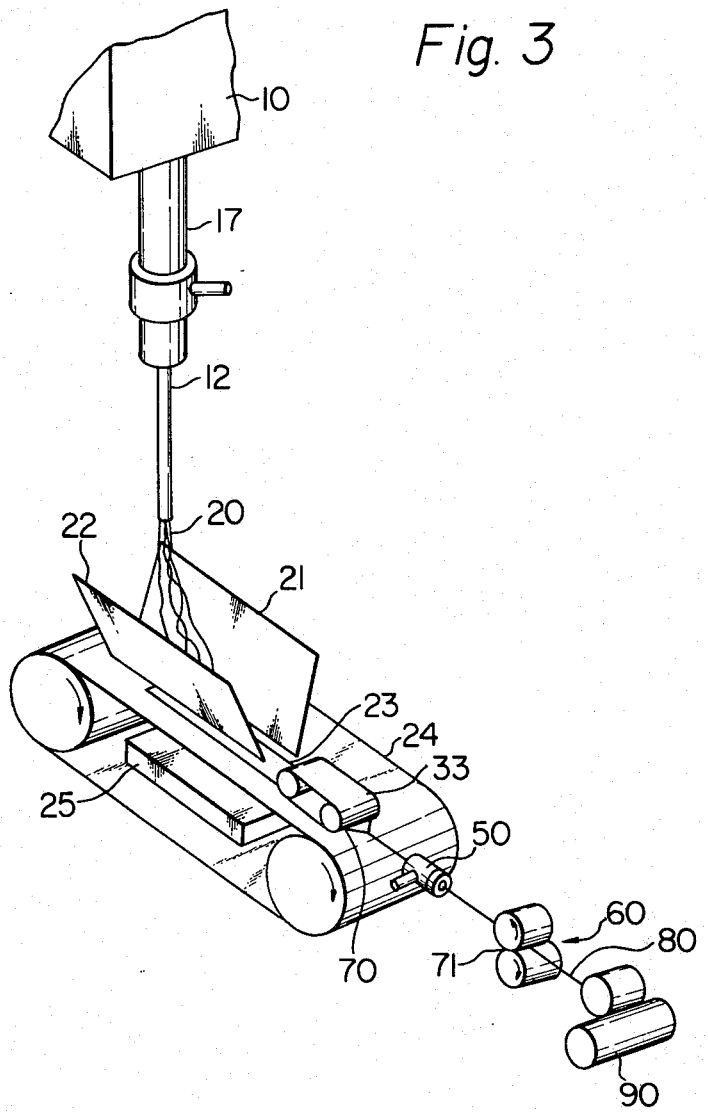
FIG. 3 is a perspective view schematically illustrating another form of the apparatus for use in the process of this invention.

Referring to FIGS. 2 and 3 wherein similar parts are designated by the same reference numerals, polymer melt is extruded into filaments through a spinneret (not shown) of a melt spinning machine 10 and the filaments thus formed are fed into an air jet nozzle or ejector 12. The filaments are stretched pneumatically by compressed air jets as they pass through said air jet nozzle or ejector 12. Then, the filaments 20, ejected through the ejector 12, are deposited on a receiving conveyor 24 which advances said filaments at a fairly low speed compared with the above-mentioned ejection speed of the filaments. The conveyor 24 comprises an endless belt or a rotating drum which is composed of wire gauge, a perforated metal plate or the like. A pair of deflector plates 21 and 22 is provided above the conveyor 24. In addition, a suction box 25 is installed under the conveyor. By the construction mentioned above, the filaments being deposited on the conveyor are formed into a ribbon-shaped bundle 23 of a proper width wherein the filaments are moderately interconnected.

In the apparatuses as shown in FIGS. 2 and 3, a perforated rotating drum or rotor may be employed in place of the conveyor and also a bottomless box may be employed as the deflector. Preferably, the deflector is so arranged that the ejected filaments impinge on its wall or plate. Further, it is preferred that fluid jets are applied on to the ejected filaments at a certain angle with respect to their running down direction, before the ejected filaments impinge on the deflector plate(s), in order to increase the number of bends and loops of the filaments projecting from the sides of the ribbon-shaped bundle, and to enhance the entanglement of the filaments.

Thus, the ribbon-shaped bundle deposited on the conveyor is substantially free from twists and is composed of randomly oriented or arranged continuous filaments, each of which comprises random bends and loops along its length. More precisely, the filaments in the bundle are randomly bent and looped along their lengths and are randomly interconnected with each other. Further, the bent and looped ends protrude beyond the side ends of the bundle. From our study, it has been found that the width of the ribbon-shaped bundle is preferably in a range between 5 and 50 mm and the average diameter of the as-spun filaments is preferably less than 5 deniers, more preferably in a range from 0.3 to 3 deniers.

The ribbon-shaped bundle thus formed is then fed into a false-twisting zone wherein the bundle is false twisted and consolidated into a yarn.

Referring again to FIGS. 2 and 3, the ribbon-shaped bundle 23 is fed into a false-twisting zone through a nip between the conveyor 24 and an apron belt 33 and supplied to a false-twisting device 50. In the false-twisting zone defined between nip points 70 and 71, the ribbon-shaped bundle is false twisted by fluid torque jets which originate in the false-twisting device 50 and concurrently are consolidated into a yarn 80 of a substantially circular cross-sectioned fiber bundle. Then, the yarn is wound into a package by a winder 90 through a delivery roller means 60.

At the time when the ribbon-shaped bundle is false twisted, some of the continuous filaments are broken into discontinuous filaments of irregular lengths by the action of the fluid torque jets and/or by the friction between the filament and the inner wall of the false-twisting device. Further, at the same time, the entanglement of the filaments is enhanced and some of both of the continuous and broken filaments are tightly wrapped around the fiber bundle. Thus, a yarn having a unique and novel configuration as mentioned hereinbefore can be obtained.

The false twisting is advantageously carried out by means of fluid torque jets in the form of compressed cold air, compressed hot air, super heated steam or the like. The fluid torque jets may be conveniently provided by a conventional false-twisting device, such as a fluid jet type twister. The apparatus whereby the process of this invention is advantageously carried out may further comprise a heater 40 and an oiling means 41, as shown in FIG. 2.

The configuration of the yarn of this invention may be controlled by adjusting the speed of the fluid jets in the ejector and/or in the false-twisting device, by varying the construction of a false-twisting device and/or by regulating the width of the ribbon-shaped bundle deposited on the conveyor, for example.

Figure 4:
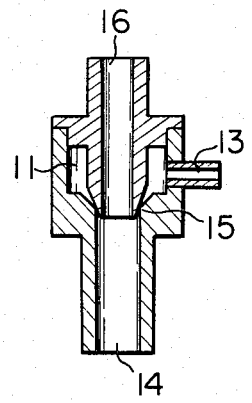
FIG. 4 is an enlarged longitudinal cross-sectional view of one form of ejector useful in practicing this invention.

FIG. 4 illustrates an embodiment of the air jet nozzle or ejector which is useful in putting the process of this invention into practice. Compressed air is supplied into a chamber 11 from an inlet 13 and ejected as an air jet to an outlet 14 through a narrow area 15. As-spun filaments are fed into an inlet 16 and ejected from the outlet 14 with said air jets. Preferably, said ejector is installed at a proper distance from a spinneret.

Figure 5:
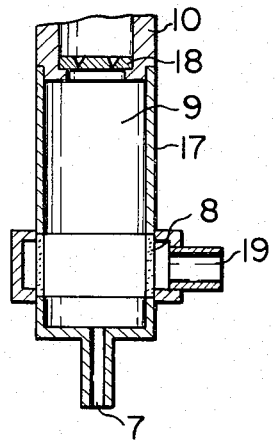
FIG. 5 is an enlarged longitudinal cross-sectional view of another form of ejector useful in practicing this invention.

FIG. 5 illustrates another embodiment of the air jet nozzle or ejector. An ejector of this type is preferably installed so that the spun filaments are introduced into the ejector without running down through open air. The ejector 17 is joined directly to a spinneret 18 attached to a spinning machine 10. Compressed air is supplied from an inlet 19 into a chamber 9 through holes 8 provided in the wall 17 of the chamber 9 and then ejected through an outlet 7 together with as-spun filaments extruded from the spinneret 18.

Figure 6:
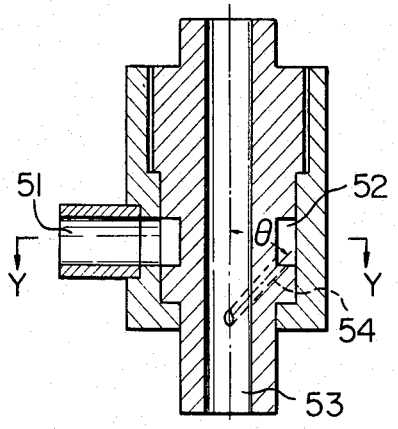
FIG. 6 is an enlarged longitudinal cross-section view of one form of false-twisting device useful in practicing this invention.
Figure 7:
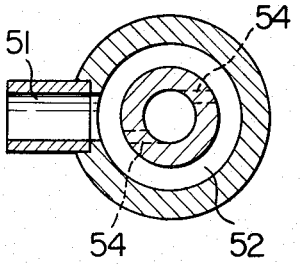
FIG. 7 is an enlarged transverse cross-section view of the device shown in FIG. 6, taken on line X–Y of FIG. 6.

An embodiment of a false-twisting device of a fluid jet is shown in FIGS. 6 and 7, which is useful in practicing the process of this invention. Compressed air is provided from an inlet tube 51 and ejected into a tubular yarn passage 53 through a chamber 52 and fluid passages 54. The fluid passages 54 are perforated so as to direct the compressed air tangentially and angularly into the yarn passage 53. Two fluid passages 54 are shown in FIG. 7, but the number of the passage need not be limited to two. In FIG. 6, it is shown that the fluid passage 54 is provided at an angle of $\theta$ with respect to the longitudinal axis (shown by a dotted line) of the tubular yarn passage 54. The angle of $\theta$ is preferably in a range of 30° to 60°, more preferably in a range of 35° to 45°, in order to impart the desired ability to twist and aspirate the fibers being processed to the false-twisting device. Thus, fluid torque jets originate in the yarn passage of the false-twisting device and fibers are false twisted and consolidated into a yarn by the fluid torque jets as said fibers pass through the false-twisting device.

As the starting materials for manufacturing the yarn of this invention, fibers such as various types of synthetic fibers and blends of synthetic fibers and natural fibers can be used. However, synthetic organic fibers made of, for example, polyesters, polyamides and polyacrylics including copolymers thereof and novolac-polyamide resins as well as blends of these polymers can be advantageously employed.

As will be appreciated, in the yarn of this invention, there may exist some discontinuous filaments having either a few or no folded ends. Further, the free ends of the broken filaments and bent and looped filaments protruding from the fiber bundle of the yarn provide desirable fuzzes on the surface of the yarn. It is preferable according to our experience that the ratio of broken ends in the fuzzes be more than 10 percent of all of the broken, bent and looped ends.

Advantages of this invention can be summarized as follows:

a. the yarn of this invention has a spun yarn-like hand and appearance;

b. the yarn of this invention is superior in bulkiness and uniformity of unwinding tension as compared with yarns of looped continuous filaments;

c. the yarn of this invention shows a higher resistance to stretching as compared with wrapping yarns made of continuous filaments;

d. spun-type yarns having desirable properties can be manufactured by a simple process without complicated steps as in the manufacturing of staple spun yarns;

e. spun-type yarns having desirable properties can be manufactured with a high rate of efficiency and at a low-cost;

f. as-spun filaments can be directly fed into the process of this invention, and;

g. spun-type yarns can be manufactured from fine denier filaments and/or filaments having poor physical properties.

Further, the following methods may be applied to this invention;

1. to feed different kinds of fibers to ejector(s);
2. to extrude different kinds of polymers simultaneously from a single spinneret to form filaments and to feed them to ejector(s);
3. to make conjugated filaments and to feed them to ejector(s);
4. to melt or to eliminate the yarn partially before or after making a yarn, and;
5. to stretch and/or twist and/or twine the yarn of this invention.

The features of this invention will be more apparent by the following illustrative, but not limitative, examples, wherein an apparatus as shown in FIG. 3 was employed in practicing the process according to this invention.

EXAMPLE 1

Polyethylene terephthalate having an intrinsic viscosity of 0.55 was extruded through a spinneret. Filaments thus obtained were fed into an ejector, in which compressed air was supplied at 1.25 kg/cm$^2$G. The ejector was installed so that the spun filaments were introduced into the ejector without running down through the open air. The filaments were ejected with compressed air jets through a 3 mm diameter orifice at a speed of 6500 m/min. and simultaneously stretched pneumatically. Said filaments were deposited on a moving receiving conveyor after impinging on a pair of deflector plates to form a ribbon-shaped bundle having a width of 15 mm. The bundle was substantially free from true twists and consisted of randomly oriented, continuous filaments having random bends and loops. The bundle was then continuously fed to a false-twisting device in which compressed air was supplied at 3.5 kg/cm²G, false-twisted by fluid torque jets provided by the false-twisting device, at a speed of 263 m/min. and wound up as a consolidated yarn at a speed of 250 m/min. The yarn was of the configulation as shown in FIG. 1. In this yarn, some continuous filaments were broken into discontinuous fibers of irregular length. The yarn was of 50 metric count and both continuous filaments and discontinuous filaments emerging from the bundle were wrapped tightly around the bundle at various angles one above another. The bundle was composed of a blend of continuous filaments and broken filaments and was substantially free from twists.

Figure 8:
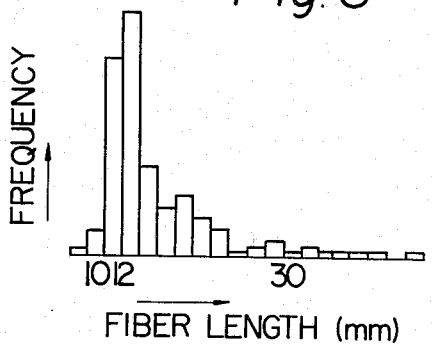
FIGS. 8 and 9 are examples of the staple diagram characteristic of the yarn of this invention.

A staple diagram of the obtained yarn is shown in FIG. 8. The values of parameters S and R were 2.7 and 0.034, respectively. Some of the properties of this yarn and these of a yarn spun by conventional ring spinning were measured and listed below in Table 1. The conventional spun yarn was composed of polyethylene terephthalate fibers having a length of 51 mm and a fineness of 2.5 deniers/fiber. As is shown in Table 1, the yarn of this invention is more bulky than the conventional ring spinning yarn and has a desirable distribution of the length of the bent, looped and broken ends. Furthermore, said yarn showed uniformity of unwinding tension when unwound from a cone in knitting due to the fact that the yarn does not have surface fibers longer than 10 mm.

Table 1

| | | | The yarn of this invention | | | The conventional ring spinning yarn | | |
|---|---|---|---|---|---|---|---|---|
| | metric count of the yarn (Nm) | | 1/50 | | | 1/50 | | |
| | Bulkiness of the yarn (cm³/gram) | | 21.2 | | | 17.6 | | |
| number of fuzzes on the surface of the yarn (per meter) | kind of fuzzes | length of fuzzes (mm) | 3–6 | 6–10 | more than 10 | 3–6 | 6–10 | more than 10 |
| | bent or looped end | | 40 | 1 | 0 | 0 | 0 | 0 |
| | fiber end | | 25 | 7 | 0 | 75 | 12 | 0 |

Figure 10:
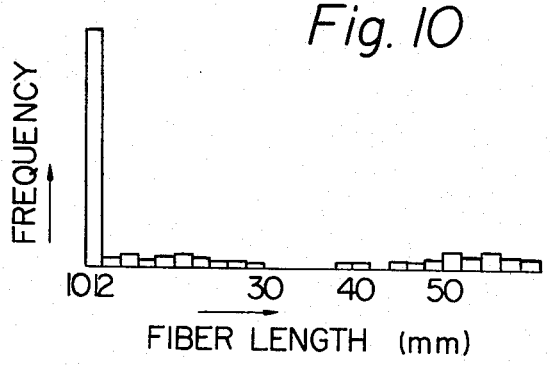
FIGS. 10 and 11 represent the staple diagrams inherent to the yarns of prior arts.
Figure 11:
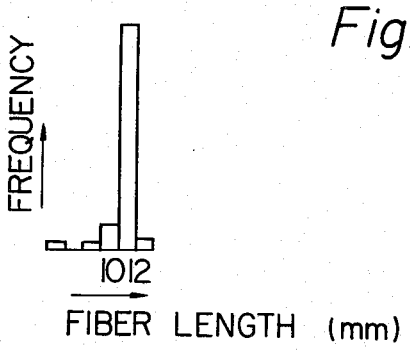

For the purpose of comparison, yarns composed of polyethylene terephthalate fibers were produced according to the methods described in British Pat. No. 1,102,095 and U.S. Pat. No. 3,079,746. The staple diagram of the yarn of British Pat. No. 1,102,095 is shown in FIG. 10 and that of the yarn of U.S. Pat. No. 3,079,746 is shown in FIG. 11. The former yarn had a parameter S value of 0.34 and a parameter R value of 0.2, while the latter yarn had a parameter S value of 0.04. Since the yarn of British Pat. No. 1,102,095 had multiple long loops on the yarn surface, the unwinding tension was not uniform and it was difficult to knit the yarn into fabric.

EXAMPLE 2

Figure 9:
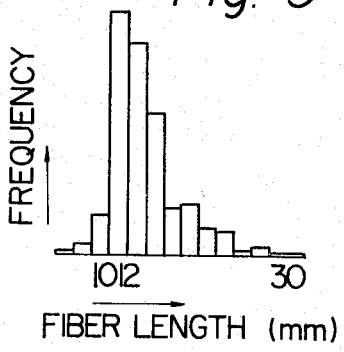

Polyethylene terephthalate having an intrinsic viscosity of 0.48 was extruded through a spinneret. Filaments thus obtained were fed into an ejector in which compressed air was supplied at 1.25 kg/cm²G, the ejector being installed so that the spun filaments were introduced into the ejector without running down through open air. The filaments were ejected with air jets through a 3 mm diameter orifice at a speed of 6500 m/min. and were simultaneously stretched pneumatically. Air jets provided by compressed air of 0.5 kg/cm²G were applied on to the ejected filaments before they impinged on the deflector plates. The filaments were then deposited on a moving receiving conveyor in the form of a ribbon-shaped bundle. The bundle was fed to the false-twisting device in which compressed air at 3.5 kg/cm²G was supplied, at a speed of 200 m/min. and was false-twisted by means of torque jets and then wound up as a consolidated yarn at a speed of 186 m/min. The yarn thus obtained was of 30 metric count and had a configuration similar to that of the yarn obtained in Example 1. The yarn had a spun-yarn-like hand and appearance. The staple diagram of this yarn is shown in FIG. 9. The values of parameters S and R were 2.1 and 0.007, respectively. The yarn was smoothly unwound from a cone and could be knitted easily.

EXAMPLE 3

The procedure in Example 2 was repeated, except that the speed of feeding a ribbon-shaped bundle to a false-twisting device was 300 m/min. and that the speed of winding the yarn was 290 m/min. The yarn thus obtained was of 47 metric count and the values of parameters S and R were 1.3 and 0.052, respectively. The yarn had a configuration similar to that of the yarn obtained in Example 1 and had a spun yarn-like hand and appearance.

EXAMPLE 4

Multifilaments made of nylon 6 (30 deniers, 12 filaments) free from oil treatment were fed into an ejector as shown in (FIG. 4) in which compressed air at 2 kg/cm²G was supplied. The ejected filaments were deposited on a receiving conveyor, which was moving at a speed of 200 m/min., in the form of a ribbon-shaped bundle and then said ribbon-shaped bundle was false-twisted by fluid torque jets and wound up at a speed of 200 m/min., as a consolidated yarn. When the bundle was false-twisted, some continuous filaments were broken into discontinuous fibers of irregular lengths. The yarn consisted of a core bundle bound together by and entangled with surface fibers emerging from said core bundle. The yarn was composed of both continuous and broken filaments having random bends and loops and core bundle was substantially free from true twists. The yarn was of 30 metric count and similar to the yarn obtained in Example 1, although the yarn had more radially projecting long loops than the yarn of Example 1. Some irregularity of unwinding tension was experienced in knitting this yarn into a fabric, but no actual trouble occurred. The values of parameters S and R of this yarn were 0.6 and 0.084, respectively.

EXAMPLE 5

Polyethylene terephthalate having an intrinsic viscosity of 0.63 was extruded. Filaments thus obtained were stretched pnuematically by passing through an ejector (as shown in FIG. 4) in which compressed air at 3.5 kg/cm²G was supplied, and then deposited on a moving receiving conveyor through deflector plates in the form of a ribbon-shaped bundle. In this example, the ejector was installed at a distance of 40 cm from the spinneret. The ejected speed of the filaments was 6000 m/min. The ribbon-shaped bundle consisted randomly oriented, continuous filaments having random bends and loops. The ejected filaments had a fineness of 1.4 deniers, a tenacity of 2.8 g/denier, and an elongation of 35%. The bundle was false twisted and wound up at a speed of 150 m/min. to obtain a yarn. Some continuous filaments were broken in the false-twisting. The yarn had a tenacity of 193 grams, and an elongation of 40%. A yarn of 50 metric count was obtained. The configuration of the yarn was similar to that of the yarn obtained in Example 1 and the yarn had a spun-yarn-like hand and appearance. The values of parameters S and R were 1.8 and 0.05, respectively.

EXAMPLE 6

Polyethylene terephthalate having an intrinsic viscosity of 0.58 was extruded and filaments thus obtained were stretched pneumatically when passing through an ejector (as shown in FIG. 4) which was installed at 40 cm from the spinneret. In the ejector, compressed air at 3.0 kg/cm²G was supplied. Ejected filaments were deposited on a moving receiving conveyor through deflector plates in the form of a ribbon-shaped bundle. The ejected speed of the filaments was 6100 m/min. The ribbon-shaped bundle consisted of folded, randomly oriented, continuous filaments of 0.3 denier per filament. The bundle was false twisted and wound up at a speed of 30 m/min. A yarn of 114 metric count was obtained and the configuration of the yarn was similar to that of the yarn obtained in Example 1. The values of parameters S and R were 2.1 and 0.02, respectively.

EXAMPLE 7

As-spun bicomponent filaments which were composed of nylon-6 as one component and a copolymer of nylon 6 and nylon 66 as another component, were fed to the apparatus. The procedure employed was as described in Example 6, except that the ejecting speed of filaments was 3600 m/min., the fineness of filament was 1.1 deniers and the winding speed of the yarn was 100 m/min. Thus, a yarn of 38 metric count was obtained. The configuration of the yarn was similar to that of the yarn in Example 1. The value of parameter S was 1.2 and the value of parameter R was 0.087. When the yarn was heated at 150° C, crimps were present.

EXAMPLE 8

Novolac resin (having an average molecular weight of 700) into which 20 percent by weight of nylon 6 was blended, was extruded into filaments and the filaments were provided to the apparatus. The procedure employed was as described in Example 6, with the exception that the ejecting speed of filaments was 4800 m/min., the distance between the spinneret and the inlet of the ejector was 60 cm and the fineness of filament was 1.1 deniers. The ejected filament had 0.6 g/denier of tenacity and 13% elongation. A 4.3 metric count yarn was obtained with a configuration similar to that of the yarn in Example 1. The value of parameter S was 3.1 and the value of parameter R was 0.03. The yarn was cured in a mixture of sulfonic acid and folmalin. The cured yarn was nonflammable.

What we claim is:

1. A yarn consisting of a fiber bundle which is substantially free from true twists and composed of continuous and discontinuous filaments being complexly intertwined with one another and comprising random bends and loops along their lengths, said yarn having a value of a parameter S of not less than 0.5 and a value of a parameter R of not more than 0.1, said parameters S and R being defined as follows:

$$S = B/A$$

$$R = C/D$$

wherein $A$ is the number of fibers contained in a test piece cut at a length of 10 mm along the yarn length under a load of 500 mg/denier and having lengths in the range of not less than 10 mm but less than 12 mm, $B$ is the number of fibers contained in the test piece and having lengths in the range of not less than 12 mm but less than 30 mm, $C$ is the number of fibers contained in the test piece and having lengths not less than 30 mm and $D$ is the number of whole fibers contained in the test piece.

2. A yarn as claimed in claim 1 wherein some of said fiber bundle composing filaments are partially and randomly wrapped around the fiber bundle while being entangled with one another.

3. A yarn as claimed in claim 1, wherein said fiber bundle contains multiple free ends of broken filaments and bent and looped filaments, protruding from said fiber bundle.

4. A yarn as claimed in claim 1, wherein the value of parameter S is not less than 1.0.

5. A yarn as claimed in claim 1, wherein said fiber bundle composing filaments are composed of a fiber forming polymer selected from polyesters, polyamides and polyacrylics and novolac-polyamide resins and the blends thereof.

6. A yarn consisting of a fiber bundle which is substantially free from true twists and composed of continuous and discontinuous filaments being complexly intertwined with one another and comprising random bends and loops along their lengths, some of said fiber bundle-composing filaments being partially and randomly wrapped around the fiber bundle while being entangled with one another, said fiber bundle containing multiple free ends of broken filaments and bent and looped filaments, protruding from said fiber bundle, said discontinuous broken filaments having irregular lengths and said surface wrapping filaments being wound around the fiber bundle at various angles with respect to the longitudinal axis of the yarn.

7. A process for manufacturing a yarn of a fiber bundle being substantially free from true twists and composed of complexly intertwined continuous and discontinuous filaments comprising random bends and loops, which process comprises forming a ribbon-shaped fiber bundle being substantially free from twists and composed of randomly oriented continuous filaments, each of which comprises random bends and loops along its length, and then false twisting the ribbon-shaped bundle to consolidate it into a yarn while some of said filaments are broken in the false twisting.

8. A process as claimed in claim 7, wherein continuous filaments are fed to a fluid jet nozzle or ejector and then deposited on a moving receiving conveyor to form said ribbon-shaped bundle.

9. A process as claimed in claim 8, wherein as-spun filaments are fed to said ejector whereon said filaments are stretched pneumatically by said fluid jet.

10. A process as claimed in claim 9, wherein said ejector is installed so that the as-spun filaments are introduced into said ejector without running down through open air.

11. A process as claimed in claim 8, wherein drawn filaments are fed to said ejector.

12. A process as claimed in claim 8, wherein the filaments ejected from said ejector impinge on the surface of a deflector installed above said moving receiving conveyor.

13. A process as claimed in claim 12, wherein fluid jet is applied to the ejected filaments before they impinge on the surface of said deflector.

14. A process as claimed in claim 7, wherein said ribbon-shaped bundle is false twisted by a fluid torque jet.

15. A process as claimed in claim 14, wherein some of said bundle composing filaments are broken into irregular lengths during the false twisting.

16. A process as claimed in claim 14, wherein some of said bundle composing filaments are partially and randomly wrapped around the bundle during the false twisting.

* * * * *